US005894260A

United States Patent [19]

Cella et al.

[11] Patent Number: 5,894,260

[45] Date of Patent: Apr. 13, 1999

[54] THERMAL SENSING BI-METAL TRIP ACTUATOR FOR A CIRCUIT BREAKER

[75] Inventors: Stephen D. Cella, Tucker, Ga.; Andrew J. Kralik, Marysville, Ohio

[73] Assignee: Siemens Energy & Automation, Inc., Alpharetta, Ga.

[21] Appl. No.: 08/772,041

[22] Filed: Dec. 19, 1996

[51] Int. Cl.[6] ..... H01H 37/52

[52] U.S. Cl. ..... 337/342; 337/3; 337/333; 337/380

[58] Field of Search ..... 337/3, 111, 112, 337/333, 334, 342, 362, 379, 380, 398; 361/103, 105

[56] References Cited

U.S. PATENT DOCUMENTS

| | | | |
|---|---|---|---|
| 1,664,845 | 4/1928 | Ball . | |
| 2,067,792 | 1/1937 | Seaman | 200/109 |
| 2,083,305 | 6/1937 | Lingal | 200/89 |
| 2,360,682 | 10/1944 | Hutt | 200/116 |
| 2,381,294 | 4/1945 | Langstroth | 200/116 |
| 2,426,880 | 3/1947 | Jackson | 200/88 |
| 2,502,537 | 11/1950 | Speck | 200/88 |
| 2,661,414 | 3/1953 | Casey | 200/116 |
| 2,816,191 | 11/1957 | Epstein | 200/106 |
| 2,844,689 | 6/1958 | Middendorf | 200/116 |
| 3,171,921 | 3/1965 | kWoods | 200/116 |
| 3,200,217 | 8/1965 | Bullis, Jr. | 52/98 |
| 3,213,249 | 10/1965 | Ellsworth et al. | 200/116 |
| 3,222,475 | 12/1965 | Woods et al. | 200/88 |
| 3,249,720 | 5/1966 | Gryctko et al. | 200/122 |
| 3,258,887 | 7/1966 | Mostoller | 52/98 |
| 3,278,707 | 10/1966 | Klein | 200/116 |
| 3,309,635 | 3/1967 | Walker | 335/35 |
| 3,319,195 | 5/1967 | Strobel et al. | 335/36 |
| 3,440,579 | 4/1969 | Smith | 335/18 |
| 3,555,468 | 1/1971 | Myers | 335/36 |
| 3,562,469 | 2/1971 | Peck | 200/169 |
| 3,594,668 | 7/1971 | Clarke et al. | 335/13 |
| 3,617,970 | 11/1971 | Osaka et al. | 337/3 |
| 3,636,410 | 1/1972 | Pardini | 317/36 |
| 3,651,436 | 3/1972 | Cooper et al. | 335/13 |
| 3,731,239 | 5/1973 | Ellenberger | 335/167 |
| 3,743,981 | 7/1973 | Gelezlunas | 335/37 |
| 3,747,033 | 7/1973 | Bennett | 335/35 |
| 3,760,308 | 9/1973 | Misencik et al. | 335/35 |
| 3,786,382 | 1/1974 | Powell | 335/169 |
| 3,944,953 | 3/1976 | Oster | 335/23 |
| 3,949,331 | 4/1976 | Cellerini et al. | 335/45 |
| 3,950,714 | 4/1976 | Mrenna et al. | 335/35 |
| 3,950,715 | 4/1976 | Bagalini et al. | 335/35 |
| 3,950,716 | 4/1976 | Cellerini et al. | 335/45 |
| 3,950,717 | 4/1976 | Cellerini et al. | 335/45 |
| 3,959,754 | 5/1976 | Mrenna | 335/35 |
| 3,968,155 | 7/1976 | Kosup | 335/36 |
| 3,973,233 | 8/1976 | Miyamoto et al. | 337/118 |
| 3,997,857 | 12/1976 | Wien et al. | 335/35 |
| 4,047,134 | 9/1977 | Maier et al. | 335/23 |
| 4,079,346 | 3/1978 | Rys | 335/23 |
| 4,090,156 | 5/1978 | Gryctko | 335/6 |
| 4,156,219 | 5/1979 | Coleman | 335/175 |
| 4,231,006 | 10/1980 | Belttary | 335/36 |
| 4,276,457 | 6/1981 | Myers | 200/153 |
| 4,276,526 | 6/1981 | Clarcia et al. | 335/35 |

(List continued on next page.)

*Primary Examiner*—Leo P. Picard
*Assistant Examiner*—Jayprakash N. Gandhi

[57] ABSTRACT

An actuator (144) for initiating a trip of a circuit breaker. Load current passes through a conductor (66) that is electrically coupled to a contact arm (56) by a braid (62). A thermally responsive bi-metal (64) has a first end portion which is disposed against a portion of the conductor (66) and through which at least a portion of load current carried by the contact arm, the braid, and the conductor passes. The bi-metal further has a second end portion that is disposed in spaced relation to the conductor and is cantilever-mounted on the portion of the conductor via the bi-metal's first end portion. The bi-metal is nominally flat and straight, but increasingly warps as thermal energy in the bi-metal increases. Upon attaining a certain degree of warping, the bi-metal initiates a trip of the circuit breaker by causing the contact arm to swing from a circuit-making to a circuit-breaking condition.

21 Claims, 9 Drawing Sheets

U.S. PATENT DOCUMENTS

| | | | |
|---|---|---|---|
| 4,276,527 | 6/1981 | Gerbert-Gaillard et al. | 335/39 |
| 4,307,359 | 2/1981 | Schultz et al. | 335/23 |
| 4,377,795 | 3/1983 | Schultz et al. | 335/23 |
| 4,399,420 | 8/1983 | Palmer et al. | 335/21 |
| 4,417,222 | 11/1983 | Schmitt et al. | 335/6 |
| 4,458,225 | 7/1984 | Forsell | 335/35 |
| 4,459,572 | 7/1984 | Fajner et al. | 335/16 |
| 4,464,641 | 8/1984 | Bellows | 335/23 |
| 4,467,297 | 8/1984 | Boichot-Castagne et al. | 335/21 |
| 4,468,645 | 8/1984 | Gerbert-Gaillard et al. | 335/42 |
| 4,479,101 | 10/1984 | Checinski | 335/23 |
| 4,492,941 | 1/1985 | Nagel | 335/13 |
| 4,503,408 | 3/1985 | Mrenna et al. | 335/35 |
| 4,513,268 | 4/1985 | Seymour et al. | 335/35 |
| 4,516,098 | 5/1985 | Krasser et al. | 335/23 |
| 4,528,531 | 7/1985 | Flick et al. | 335/23 |
| 4,535,309 | 8/1985 | Moreau et al. | 335/42 |
| 4,553,115 | 11/1985 | Grumert et al. | 335/14 |
| 4,608,545 | 8/1986 | Kralik | 335/16 |
| 4,617,540 | 10/1986 | Westermyer | 335/35 |
| 4,641,001 | 2/1987 | Fujihisa et al. | 200/153 |
| 4,675,635 | 6/1987 | DiMarco et al. | 335/35 |
| 4,677,406 | 6/1987 | Landron et al. | 335/35 |
| 4,679,016 | 7/1987 | Ciarcia et al. | 335/132 |
| 4,679,018 | 7/1987 | McKee et al. | 335/167 |
| 4,679,019 | 7/1987 | Todaro et al. | 335/172 |
| 4,713,636 | 12/1987 | Lemmer et al. | 335/35 |
| 4,714,907 | 12/1987 | Bartolo et al. | 335/45 |
| 4,733,211 | 3/1988 | Castonguay et al. | 335/16 |
| 4,761,626 | 8/1988 | Tersoka | 335/195 |
| 4,791,393 | 12/1988 | Flick et al. | 335/16 |
| 4,864,261 | 9/1989 | Kandatsu | 335/16 |
| 4,868,529 | 9/1989 | Holland | 335/42 |
| 4,885,558 | 12/1989 | Harper | 335/8 |
| 4,912,441 | 3/1990 | Runyan et al. | 335/185 |
| 4,922,220 | 5/1990 | Livesey et al. | 337/82 |
| 4,929,919 | 5/1990 | Link et al. | 337/38 |
| 4,945,325 | 7/1990 | Toda et al. | 335/16 |
| 5,006,826 | 4/1991 | Knoben et al. | 335/35 |
| 5,101,186 | 3/1992 | Durum | 337/76 |
| 5,103,198 | 4/1992 | Morel et al. | 335/6 |
| 5,117,208 | 5/1992 | Nar | 335/8 |
| 5,117,210 | 5/1992 | Castonguay et al. | 335/172 |
| 5,126,708 | 6/1992 | Palaia et al. | 335/35 |
| 5,146,195 | 9/1992 | Castonguay et al. | 335/35 |
| 5,173,674 | 12/1992 | Pannenborg et al. | 335/35 |
| 5,182,532 | 1/1993 | Klein | 335/35 |
| 5,225,800 | 7/1993 | Pennenborg et al. | 335/35 |
| 5,245,302 | 9/1993 | Bruno et al. | 335/35 |
| 5,285,180 | 2/1994 | Reac et al. | 335/202 |
| 5,294,901 | 3/1994 | Tecinelli et al. | 335/35 |
| 5,363,076 | 11/1994 | Miller et al. | 335/16 |
| 5,432,491 | 7/1995 | Peter et al. | 335/35 |

THERMAL SENSING BI-METAL TRIP ACTUATOR FOR A CIRCUIT BREAKER

FIELD OF THE INVENTION

This invention relates generally to electric circuit protection devices. In a more specific aspect, it relates to a construction for associating a bi-metal thermal trip actuator with other components of a circuit breaker.

BACKGROUND AND SUMMARY OF THE INVENTION

One design criterion for a circuit breaker holds that upon occurrence of a load fault which creates an unacceptably large current draw (e.g., a short circuit current) through closed contacts of a circuit breaker, the circuit breaker mechanism must open the contacts in a manner that promptly terminates the current. Certain known circuit breakers that employ one or more pivotally mounted contact arms utilize electromagnetic blow-apart, or blow-open, force to blow open the contact arm(s) upon the occurrence of such a sudden load fault. Although the blow-open force quickly initiates contact arm motion to begin tripping the circuit breaker, current may continue to arc across the contacts as the contact arm(s) swing open. consequently, further circuit breaker design principles include minimizing (and ideally eliminating) such arcing as the tripping continues. Furthermore, once current flow has terminated, any opportunity for its re-establishment must be foreclosed as the tripping concludes.

In accomplishing prompt arrest of current arcing across blowing-open contacts, it may be desirable for the circuit breaker mechanism to augment the impetus of the blow-open force as the tripping continues toward conclusion. But in doing so, the mechanism's augmentation of the force acting on the swinging contact arm(s) must not induce rebound of the contact arm(s) off of a stop to an extent that could potentially re-establish current flow.

Consider for example a circuit breaker that employs a spring-loaded, over-center toggle mechanism which goes over-center during the trip. As the mechanism goes over-center, an operating spring which had been effectively applying to the contact arm(s), a force resisting, but not preventing, the trip, now suddenly applies its force to aid the trip, driving the swinging contact arm(s) against the stop. That added force must not cause excessive contact arm rebound from the stop.

Circuit breaker design must therefore take into consideration various factors that may conflict. A better circuit breaker design will account for such factors to provide a circuit breaker that will terminate a specified fault current within a specified response time, with better assurance that current will not be re-established once the circuit breaker has been tripped. Moreover, a successful circuit breaker design should be cost and space efficient.

It is toward these and other objectives that the present invention is directed.

A known actuator for tripping a circuit breaker comprises a bi-metal strip that increasingly warps as it is increasingly heated. When heated above a certain point where a circuit breaker should be tripped, the strip will have warped sufficiently to cause the associated trip mechanism to enable the trip. A known trip mechanism conducts electric current through the length the strip inducing ohmic heating of the bi-metal.

The present invention relates to a novel construction for associating a bi-metal actuator with other associated parts that avoids conducting electric current through the entire length of the strip. The present invention is believed to cause less stress in the bi-metal and reduce the potential for damage to it, especially when a circuit breaker is tripped due to a short circuit fault.

In the illustrated embodiment, the invention is carried out by mounting a nominally flat bi-metal strip in cantilever fashion on a load terminal. More specifically, one end portion of the bi-metal is disposed flat against, and joined to, a portion of a load terminal. The other end portion of the bi-metal is spaced from the load terminal so as to be capable of warping as the thermal energy in the strip increases. When the thermal energy in the strip reaches a level where the circuit breaker should be tripped, the cantilevered portion of the strip will have warped sufficiently to enable tripping via the associated trip mechanism.

Because only the cantilevered portion of the strip warps, it may be considered as an active portion while the portion joined to the load terminal may be considered as an inactive portion because it is constrained by its joinder to the load terminal. It is believed that current passing through the load terminal passes substantially only through the inactive portion of the bi-metal so that substantially no current passes through the active portion. Because of this, it is further believed that the bi-metal should be subject to less stress and reduced potential for damage than might otherwise be the case without denigrating the effectiveness of strip warping to enable a trip. Thermal energy input to the bi-metal that is needed to operate the trip mechanism is caused by ohmic heating occurring in the inactive portion of the strip. That heat will flow from the inactive portion to the active portion because the bi-metal is a thermal conductor. Therefore the active portion of the strip will warp, but without conducting significant current, if indeed any current at all.

By further arranging the active portion of the bi-metal to face relatively closely and directly a portion of the load terminal, heat generated in that portion of the load terminal due to current flowing through it can radiate and/or convect to the confronting bi-metal, thereby augmenting the thermal energy input to the bi-metal. It is believed that this may accelerate a trip and further reduce the potential for damaging the bi-metal upon occurrence of a fault, especially one due to a short circuit.

Accordingly, one aspect of the present invention relates to an actuator for enabling a trip comprising a conductor through which current passes, a thermally responsive bi-metal having a first end portion which is disposed against a portion of the conductor and through which at least a portion of current carried by the conductor passes, the bi-metal further comprising a second end portion that is disposed in spaced relation to the conductor and is cantilever-mounted on the portion of the conductor via the bi-metal's first end portion, and that increasingly warps as thermal energy in the bi-metal increases for enabling a trip upon attaining a certain degree of warping.

Another aspect of the present invention relates to a circuit breaker comprising a first conductor member through which current passes from a line terminal to a load terminal, a mounting movably mounting the first conductor member for selective operation to a circuit-making condition enabling current to flow between the line and load terminals and to a circuit-breaking condition preventing current flow between the line and load terminals, an operating mechanism for moving the first conductor member, a trip mechanism that operates via the operating mechanism to enable the first conductor member to move from circuit-making condition to circuit-breaking condition and thereby trip the circuit breaker, and an actuator for causing the trip mechanism to enable a trip comprising a second conductor member through which current carried by the first conductor member passes, a thermally responsive bi-metal having a first end portion which is disposed against a portion of the second conductor member and through which at least a portion of current carried by the two conductor members passes, the bi-metal further comprising a second end portion that is disposed in spaced relation to the second conductor member and is cantilever-mounted on the portion of the second conductor member via the bi-metal's first end portion, that increasingly warps as thermal energy in the bi-metal increases, and that, upon attaining a certain degree of warping, causes the trip mechanism to enable a trip by enabling the first conductor member to move from circuit-making condition to circuit-breaking condition.

The foregoing, along with further features, advantages, and benefits of the invention, will be seen in the ensuing description and claims, which are accompanied by drawings. The description and drawings disclose a presently preferred embodiment of the invention according to the best mode contemplated at this time for carrying out the invention.

DESCRIPTION OF THE PREFERRED EMBODIMENT

FIGS. 1–10 show the organization and arrangement of an exemplary circuit breaker 40 embodying principles of the present invention. In the ensuing description, positional and directional references will be made in relation to the orientations of the Figures, and such references should not necessarily be construed to imply that they are absolute references. For example, references to up and down are not to be necessarily construed to mean vertical. Circuit breaker 40 comprises a base 42 and a cover 44 that are assembled together to form a housing that encloses the internal components while providing for external connection of electric current conductors and for manual operation of the breaker to on and off positions.

Figure 1:
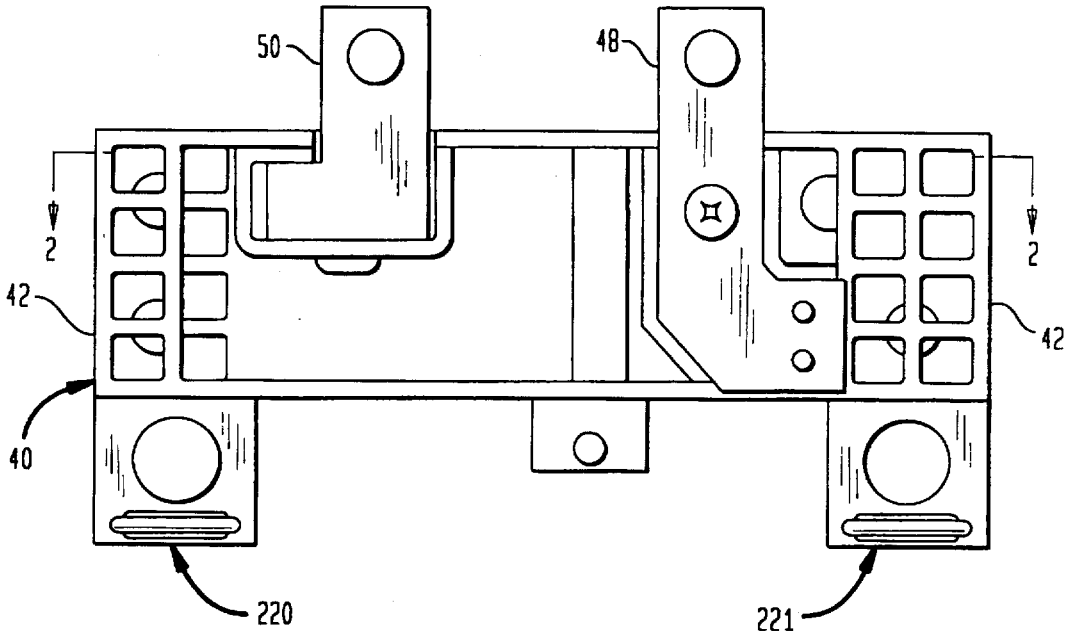
FIG. 1 is a bottom plan view of a circuit breaker embodying principles of the invention.
Figure 2:
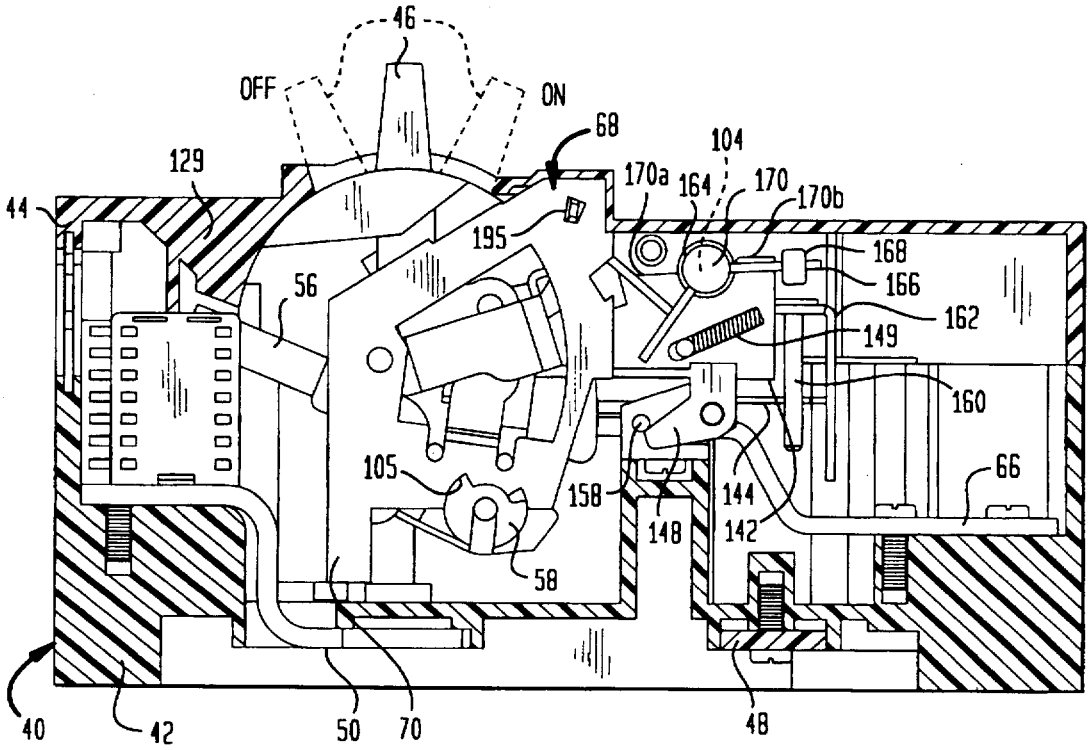
FIG. 2 is a cross section view in the direction of arrows 2—2 in FIG. 1 and depicts a tripped condition of the circuit breaker.
Figure 3:
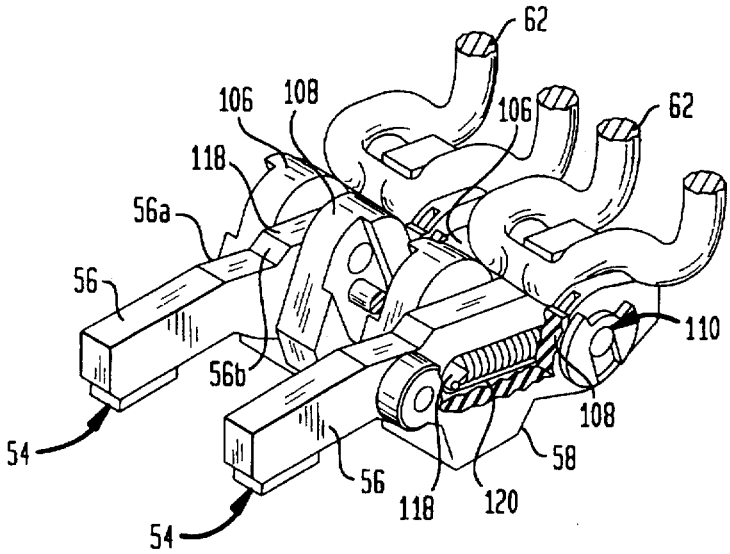
FIG. 3 is a perspective view of a portion of two load terminal assemblies and a crossbar apart from the circuit breaker.
Figure 11:
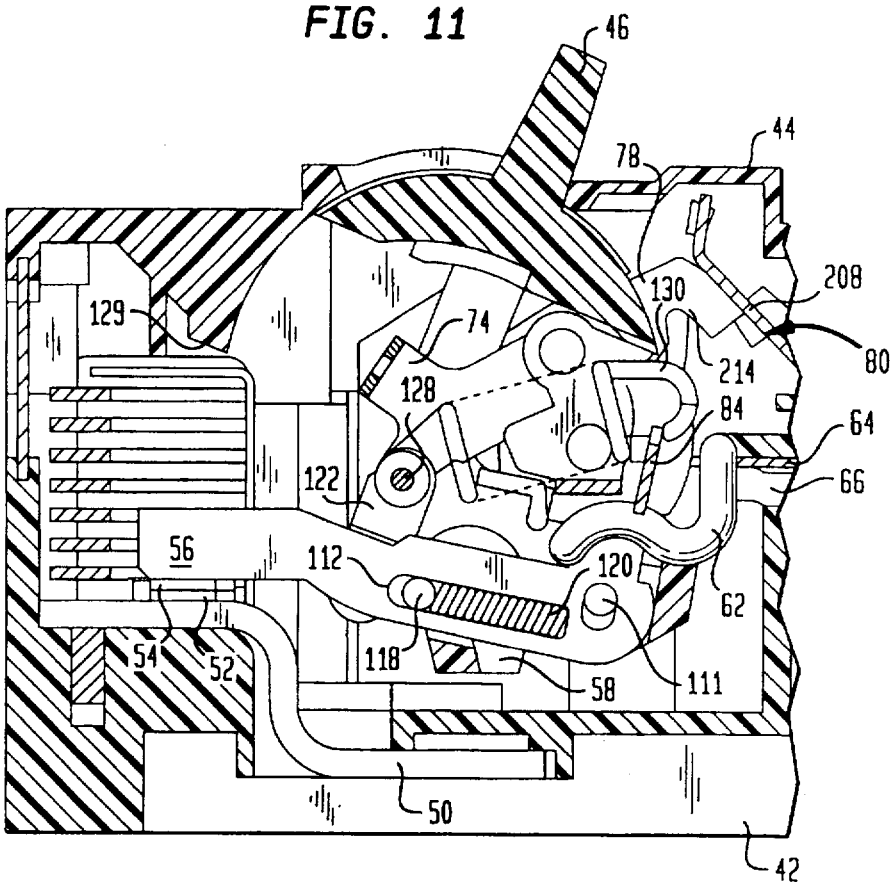
FIG. 11 is an enlarged view looking at the left hand portion of FIG. 2, but with the circuit breaker in an on position, and with certain portions of the operating mechanism broken away to reveal an operative association of the operating mechanism assembly, a contact arm, and a latch.
Figure 27:
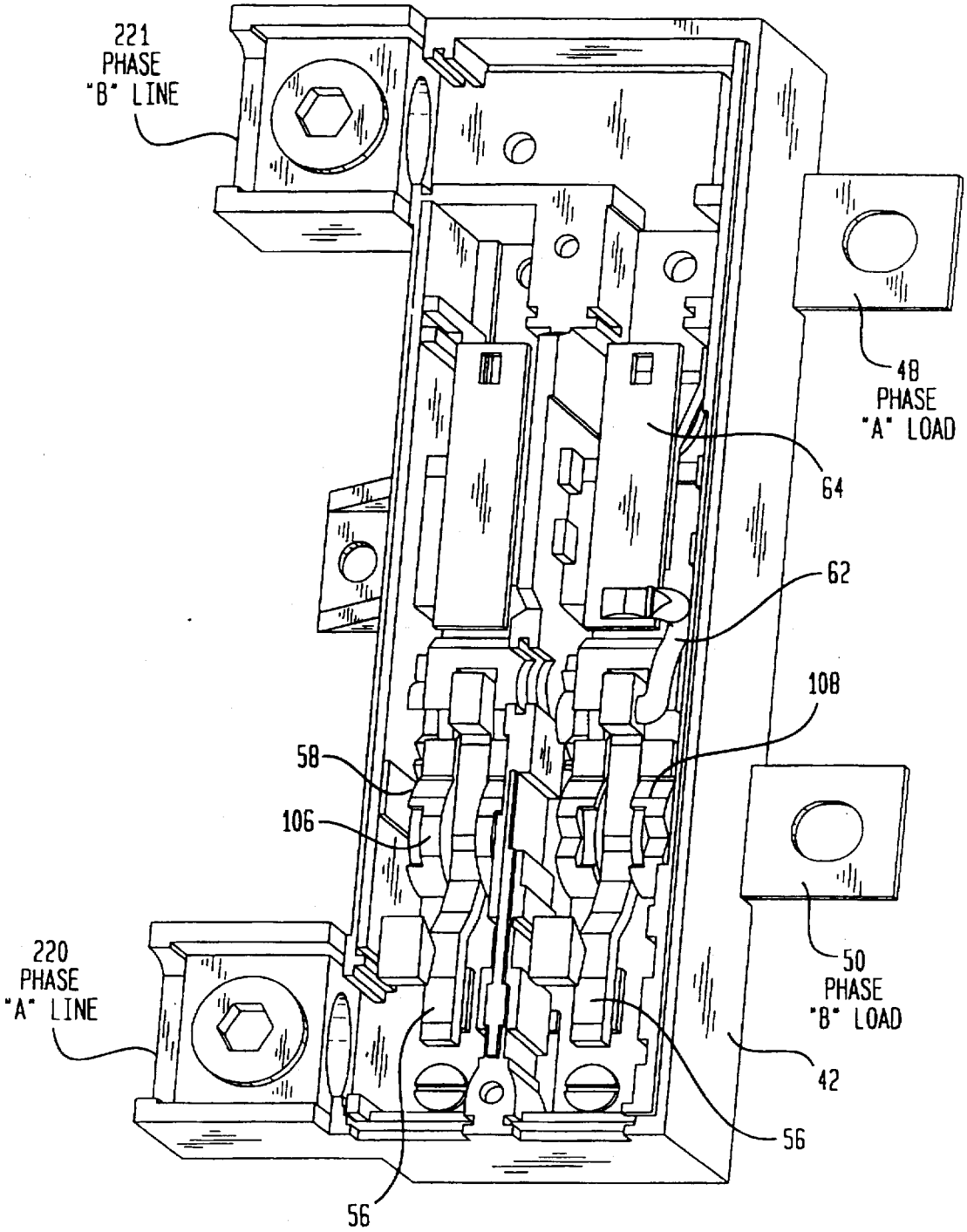
FIG. 27 is a perspective view from the top showing the interior of the circuit breaker with the cover and certain internal parts removed for illustrative purposes.

Manual operation is accomplished by a handle 46 shown in FIG. 2 in tripped position. The handle position shown to the left in phantom is off position, and the position shown to the right in phantom is on position. As shown in FIG. 27, connections 220, 221 provide for connection of the circuit breaker to a voltage source having A and B phases when the circuit breaker is installed for use. First and second straps 48 and 50 are disposed on the bottom of base 42 to provide for connection to a load. Straps 48 and 50 extend into the housing interior where a first fixed contact 52 (see FIGS. 11–13 also) is disposed on strap 50. A second fixed contact 52 is disposed on a conductor piece that is in contact with connection 220. The pair of spaced apart fixed contacts 52 are disposed for cooperation with respective movable contacts 54 that are mounted on the ends of respective contact arms 56. FIG. 3 shows the two contact arms in association with a cross bar 58. Each contact arm forms a portion of a load terminal assembly 60, a first of which is shown by itself in FIGS. 4 and 5.

Figure 4:
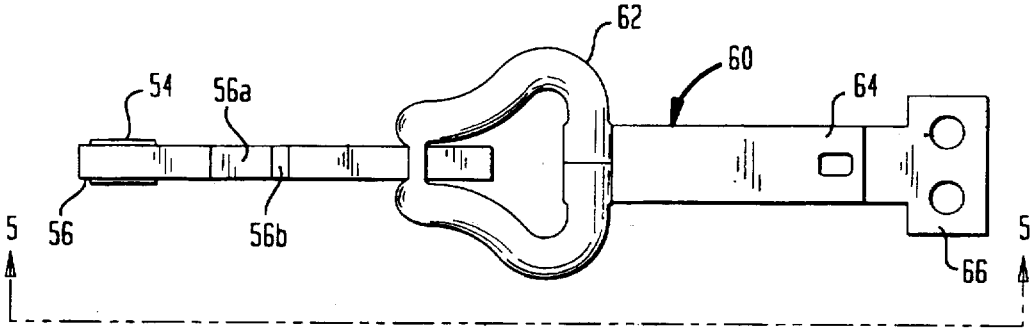
FIG. 4 is a top plan view of a load terminal assembly by itself on a scale larger than that of FIG. 3.
Figure 5:
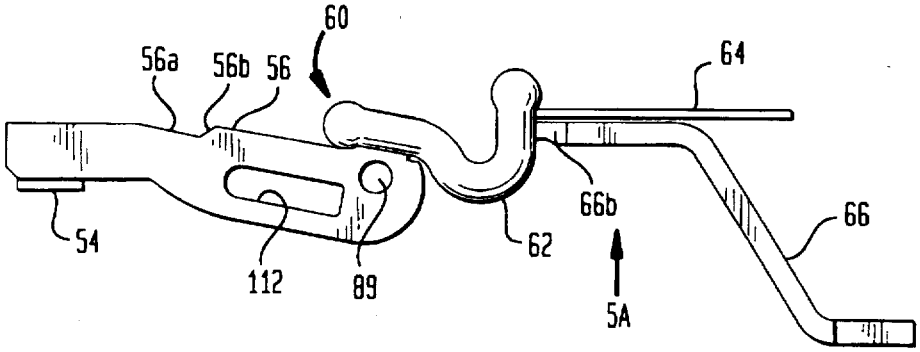
FIG. 5 is an elevation view of the load terminal assembly in the direction of arrows 5—5 in FIG. 4.
Figure 5A:
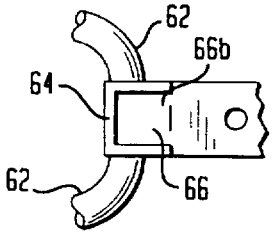
FIG. 5A is a fragmentary view in the direction of arrow 5A in FIG. 5.
Figure 6:
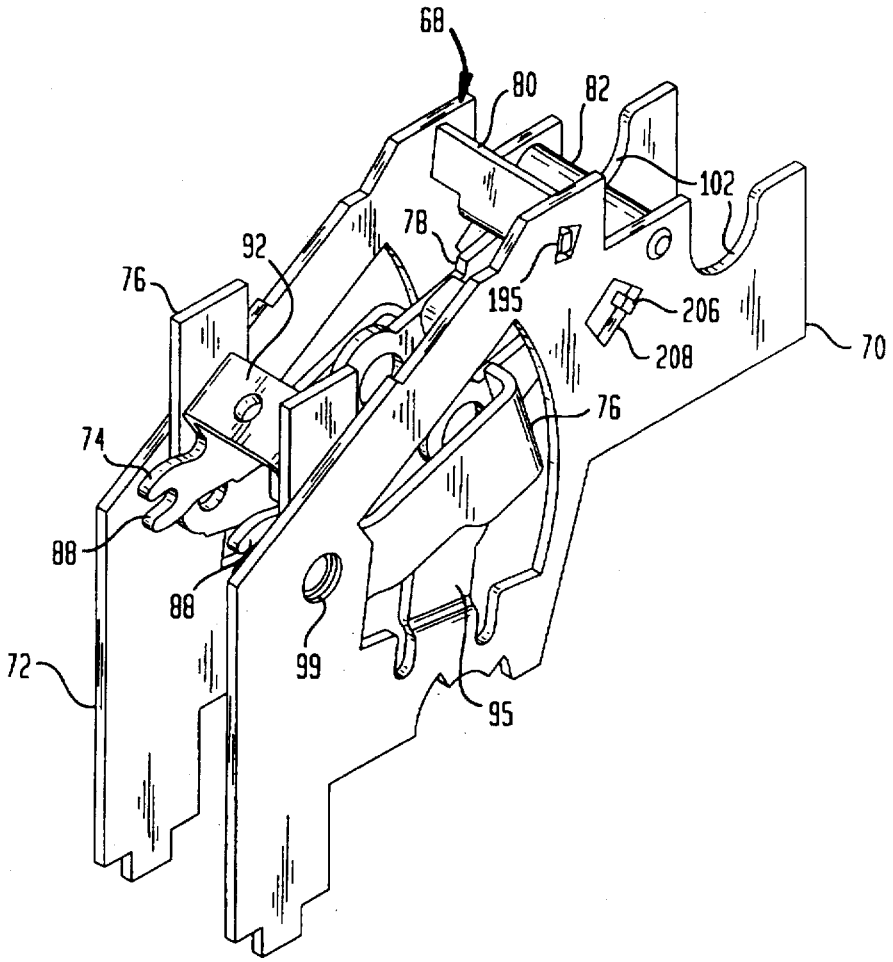
FIG. 6 is a perspective view of an operating mechanism assembly of the circuit breaker apart from the circuit breaker.
Figure 7:
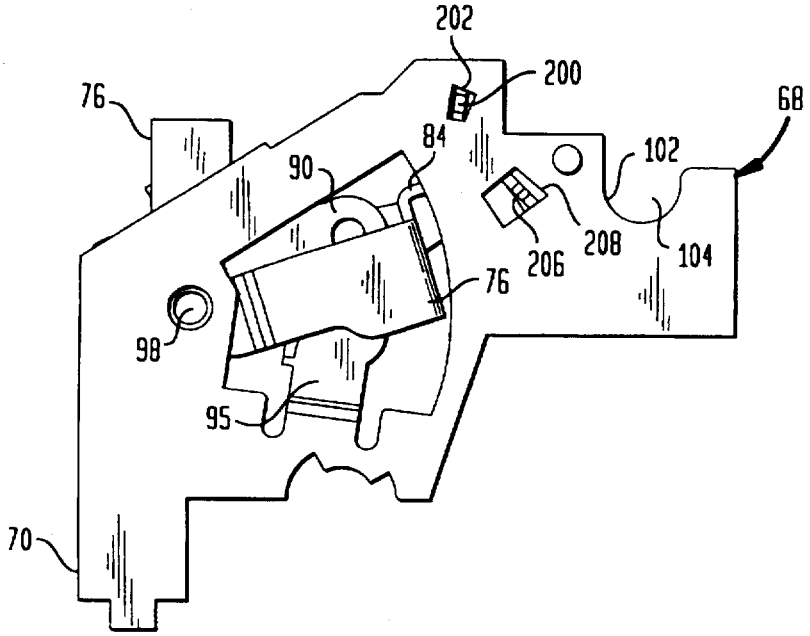
FIG. 7 is a side elevation view of the operating mechanism assembly of FIG. 6.
Figure 8:
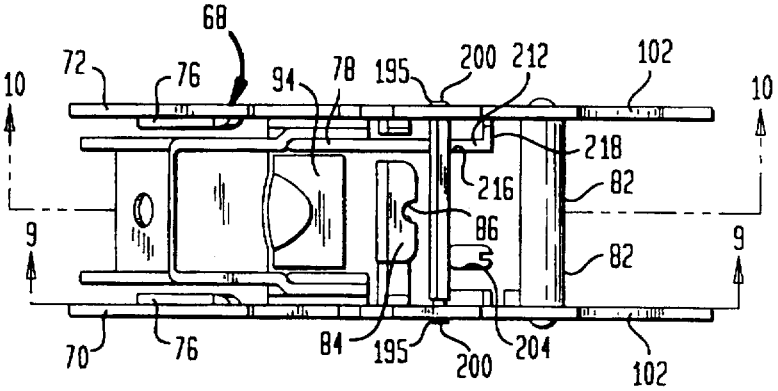
FIG. 8 is a top plan view of the operating mechanism assembly of FIG. 7.

In addition to its contact arm 56, a load terminal assembly 60 comprises a braid 62, a bi-metal strip 64, and a load terminal 66. Both load terminals 66 are fixedly mounted on the bottom of base 44. The load terminal of the assembly shown in FIGS. 4 and 5 is in conductive contact with strap 48. The load terminal 66 of the second load terminal assembly, which can be seen in FIG. 2, has a shape different from that of the load terminal of the first load terminal assembly. This second load terminal extends to the right in FIG. 2 and then, as shown in FIG. 27, continues at a right angle to make conductive contact with connection 221. A load terminal assembly 60 therefore provides a current path from its contact 54, through its contact arm 56, through its braid 62, through bi-metal 64 and through its load terminal 66. When each contact 54 is closed against the respective fixed contact 52, a respective current path is completed through the respective load terminal assembly between a respective one of straps 48 and 50 and a respective one of the line connections 220 and 221. Hence, the illustrated circuit breaker embodiment provides, by way of example, two interruptable current paths, and it is to be appreciated that principles of the invention may be incorporated in both single- and multiple-pole circuit breakers.

FIGS. 6–10 show detail of an operating mechanism assembly 68. Assembly 68 comprises: side frames 70, 72 on opposite sides of the assembly; an upper toggle 74; a handle arm 76; a cradle 78; a latch 80; and a spacer bar 82. Handle arm 76 comprises generally L-shaped sides immediately inboard of the respective side frames 70, 72, the L-shaped side immediately inboard of side frame 70 being readily apparent in FIG. 9. The free leg of each "L" projects upwardly in FIG. 9 to provide for handle 46 to be attached to handle arm 76. The other leg of each "L" forms one side of a yoke that is completed by a bridge 83 of the handle arm that extends perpendicularly between the L-shaped sides, and that contains a central bent tab 84 having a central notch 86.

Upper toggle 74 nests between the L-shaped sides of handle arm 76 and comprises sides immediately inboard thereof. The opposite ends of each of the upper toggle's sides contain respective forks 88, 90. A bridge 92, proximate forks 88, joins the two sides of the upper toggle.

Figure 9:
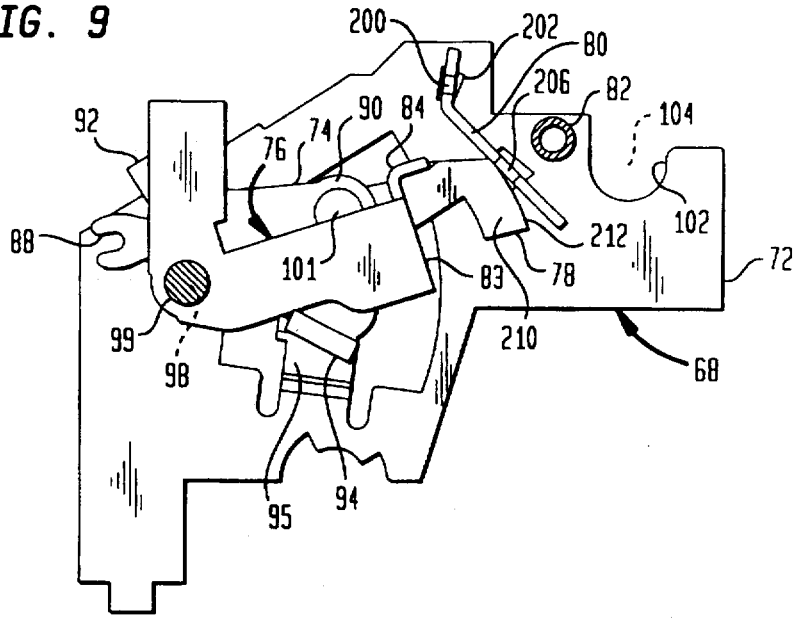
FIG. 9 is a view taken generally in the direction of arrows 9—9 in FIG. 8.
Figure 10:
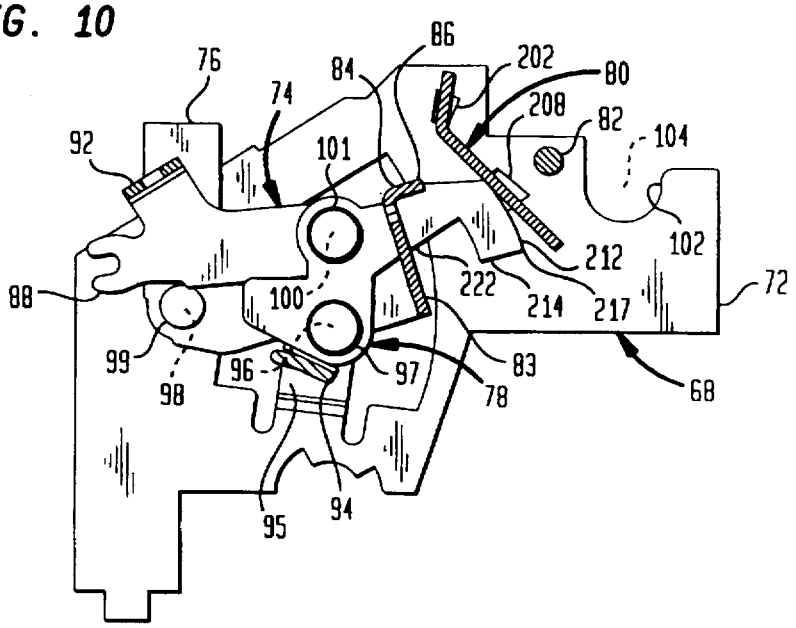
FIG. 10 is a cross section view in the direction of arrows 10—10 in FIG. 8.

A portion of cradle 78 nested between the sides of upper toggle 74 comprises sides immediately inboard thereof. The cradle sides are joined by a bridge 94 that is disposed beneath both upper toggle 74 and handle arm 76, as shown in FIGS. 9 and 10. The one cradle side that is proximate side frame 72 has a different shape from the other cradle side, and that shape is adapted for cooperation with latch 80 in a manner that will be subsequently explained. Side frames 70, 72 contain large apertures, from a lower edge of which project supports 95. Pivot pins 97 at the free ends of these supports provide for the pivotal mounting of cradle 78 about an axis 96.

Integrally provided between side frames 70, 72 and handle arm 76 are pivots 99 that provide pivotal mounting of handle arm 76 about an axis 98. Integrally provided between cradle 78 and upper toggle 74 are pivots 101 that are engaged by forks 90 of upper toggle 74 to provide a pivotal connection between upper toggle 74 and cradle 78 about an axis 100. The side frames also contain aligned pivot receptacles 102 for pivotal mounting of a trip bar, described later, about an axis 104. Spacer bar 82 attaches to the frame sides, serving as a structural member by maintaining the frame sides in fixed relation.

FIG. 2 shows operating mechanism assembly 68 supported on the bottom of base 42 by side frames 70, 72 (although only 70 can be seen), and in the process, capturing cross bar 58 on the bottom of the base by means of notches 105 which are shaped in relation to portions of the cross bar which they engage, to allow limited pivoting of the cross bar on base 42. FIG. 3 shows the cross bar to comprise two pairs of mutually parallel walls 106, 108 that are parallel to the side frames. Between each pair of walls 106, 108, there is a slot that provides space for receiving a portion of the respective contact arm 56. The position depicted by FIG. 3 is that of the contacts 54 contacting contacts 52 although the latter are not shown in that Figure.

Figure 12:
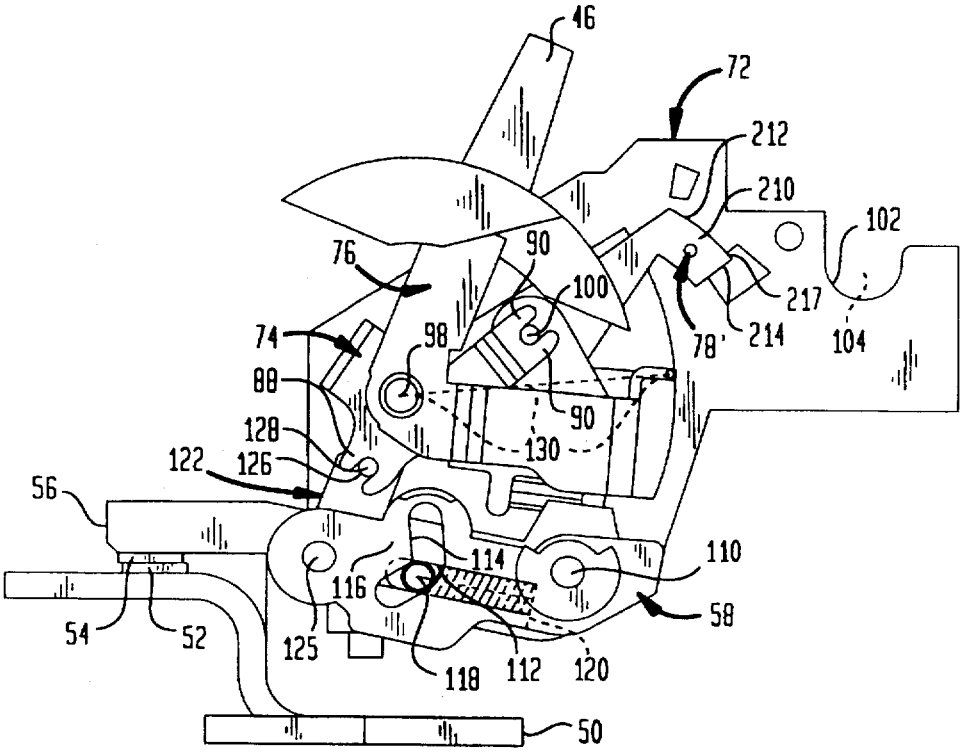
FIG. 12 is a view similar to FIG. 11, but including some of the portions that were broken away in FIG. 11.

Each contact arm 56 comprises a hole 59 (FIG. 5) that provides for the pivotal mounting of the contact arm on the cross bar. A respective hinge, or pivot, pin 110 (FIGS. 3 and 11–13) passes through each of these contact arm holes and through aligned holes in the cross bar on either side of the contact arm. Each contact arm further comprises a straight elongate slot 112 that runs generally lengthwise of the contact arm, hence generally transverse to the direction of contact arm swinging, and is closed at both ends. Adjacent each slot 112, each wall 106, 108 contains a corresponding slot 114 (FIG. 12) that has a knee 116. Slots 114 are generally transverse to the length of the contact arm. Each slot 114 has a straight above-knee segment above knee 116 and a straight below-knee segment below knee 116, as viewed in FIG. 12, forming a track. The above-knee and the below-knee segments of each of slots 114 make an obtuse angle that faces toward the lengthwise end of the contact arm that contains contact 54. A respective cylindrical blow-open pin 118 passes through slot 112, and the two bent slots 114 to each side. The two pins 118 are prevented from contacting each other by an integral formation in cross bar 58. FIG. 12 shows the relative positions of pins 118 and slots 112, 114, when contacts 54 are making contact with contacts 52. Additionally, a small helical coiled compression spring 120 occupies each slot 112 and is compressed between pin 118 and the end of slot 112 that is proximate the contact arm pivot hole 59. Each spring 120 is laterally confined by walls 106, 108 so as to remain in the described position in the respective slot 112. This aspect of circuit breaker 40 is the subject of co-pending, commonly assigned patent application CONTACT ARM WITH INTERNAL IN-LINE SPRING Ser. No. 08/772,044, filed Dec. 19, 1996.

Figure 25:
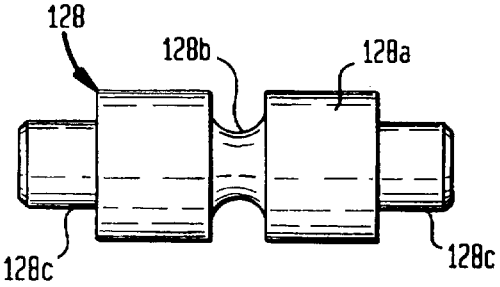
FIGS. 25 and 26 are respective plan and right side views of another component of the circuit breaker shown by itself on an enlarged scale apart from the circuit breaker.
Figure 26:
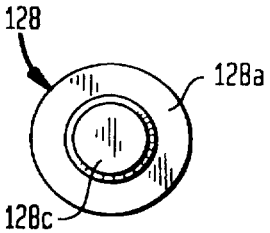

A lower toggle 122 (FIGS. 11–13) acts between upper toggle 74 and cross bar 58. Lower toggle 122 comprises sides each having pivot connections 124, 126 at opposite ends. Respective pins 125 project outboard a short distance from each wall 106, 108 of each pair of walls 106, 108. Connections 124 engage pins 125 while connections 126 engage a spring pin 128. Detail of spring pin 128 appears in FIGS. 25 and 26, which show it to comprise: a cylindrical body **128*a*, that is circular, but for a central groove 128*b*; and circular cylindrical ends 128*c* of smaller diameter than body 128*a***.

Spring pin 128 operatively couples forks 88 of upper toggle 74 and connections 126 of lower toggle 122 to create a toggle mechanism. An operating spring 130, shown schematically in FIG. 12, extends between tab 84 of handle arm 76 and spring pin 128 to make the toggle mechanism a spring-loaded over-center toggle mechanism. One end of spring 130 is hooked around groove **128*b* while the opposite end is hooked onto the end of tab 84 via notch 86. In the on position of circuit breaker 40, spring 130 is to one side of over-center, wherein its force urges the toggle mechanism to force cross bar 58 counterclockwise as viewed in FIGS. 11 and 12. Cross bar 58 in turn acts via each blow-open pin 118 to force contacts 54 against contacts 52. It is believed that this force is desirable for promoting better conductive contact between the closed contacts 52, 54. The cross bar 58 continues to rotate about pivot point 110 after the contacts 52 and 54** meet so as to provide adequate contact when the contacts begin to wear.

When circuit breaker 40 is being tripped due to a short circuit fault, the initial motion of contact arms 56 away from their respective contacts 52 due to the blow-open forces, results in a blow-open pin 118 traveling upward within the below-knee segment of slots 114 below knees 116. Before a blow-open pin reaches knees 116, the contact arm motion is slightly resisted, but not prevented, by increasing compression of the respective spring 120. But once a pin goes over the knees into the above-knee segments of slots 114, the spring will aid, rather than oppose, the contact arm opening motion.

Circuit breaker 40 further comprises a trip mechanism that, as will be described in detail later, operates, as a blow-open pin 118 is moving within slots 114, to release operating mechanism assembly 68 from latched condition so that it is allowed to operate to tripped condition. After a pin 118 has crossed over knees 116 into the second segment of slots 114, the respective swinging contact arm 56 strikes spring pin 128 to either side of groove **128*b*, forcing the spring pin to begin moving with the swinging contact arms. Cross bar 58 is therefore forced to pivot with the contact arms and spring pin. The result is that the toggle mechanism begins to collapse, but against the resistance of spring 130 until the toggle mechanism goes over-center. Once the mechanism goes over-center, spring 130 now aids, instead of opposes, the contact arm opening motion. Opening motion of contact arms 56 is stopped by abutment with internal stops 129 (shown in FIG. 2) in cover 44**.

The mechanism limits contact arm rebound from stops 129 so that the contact arms do not swing back to a point that would otherwise cause the spring-loaded toggle mechanism to go back over-center and drive the contact arms back into re-closure of their contacts 54 with fixed contacts 52. The rebound energy is partially absorbed because cross bar 58 continues momentarily to pivot clockwise as the contact arms are rebounding counterclockwise. The relative opposing motions cause blow-open pins 118 to travel downwardly within the above-knee segment of slots 114 and back across knees 116, compressing springs 120 until going over the knees. Upon a blow-open pin 118 entering the below-knee segment of slots 114 below knees 116, the respective spring 120 begins to expand and deliver force in a sense urging the respective contact arm more fully into the space between the respective pair of side walls 106, 108 in cross bar 58.

Figure 13:
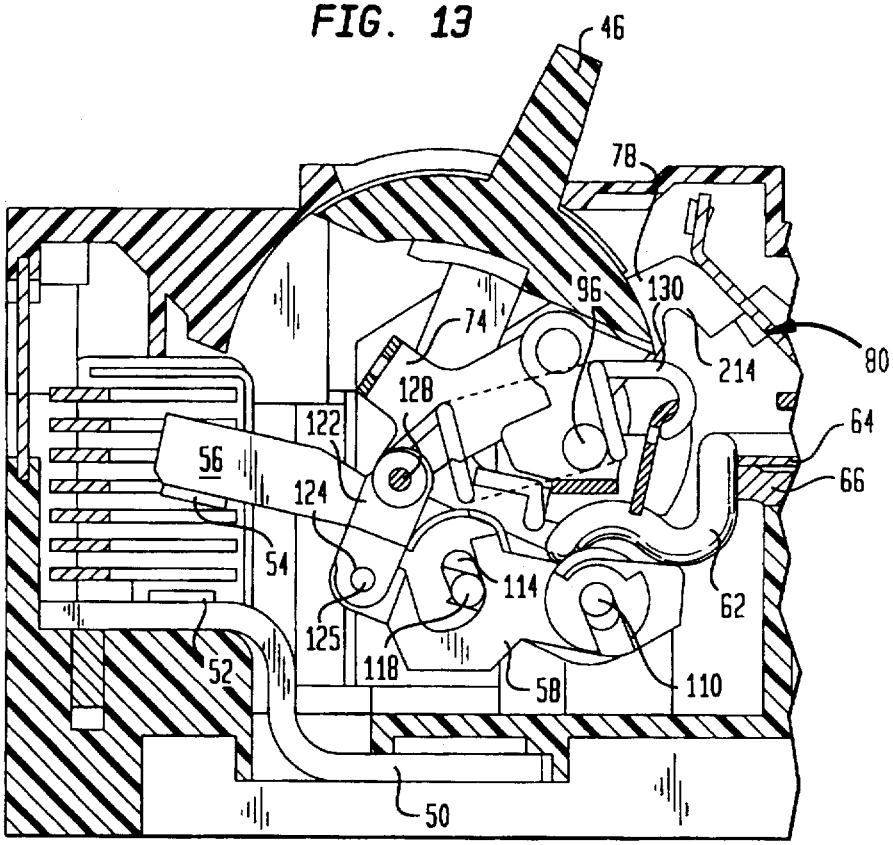
FIG. 13 is a view similar to FIG. 11, but representing contact arm motion during blow off.

It is to be observed in FIGS. 3–5 and 13 that the upper edge surface of each contact arm 56 is shaped with two edge surface portions **56*a*, 56*b* at an obtuse angle to form a V-notch. FIG. 13 shows, by way of example, a V-notch contacting body 128*a* of spring pin 128 at two distinct locations, one being at edge surface portion 56*a*, and the other being at edge surface portion 56*b*. In this way FIG. 13 in effect shows spring pin 128 seated in a V-notch once its contact arm has been driven to engage the spring pin. As a result of the interaction of the V-notches with the circular cylindrical exterior of the spring pin, the force applied by each swinging-open contact arm to the spring pin occurs along an arc whose shape is defined by the geometric shape of the V-notches in conjunction with the geometry of the pivot axes involved. Edge surface portions 56*a*, 56*b* are angled such that a principal component of the contact arm force is directed in a sense that fully, or at least approximately, maximizes the effect of the swinging contact arm force in collapsing the toggle mechanism. Because cradle 78 is pivoted about axis 96 and upper toggle 74 about axis 100, the arc of travel of the spring pin axis is a compound arc, rather than a strictly circular one. As the contact arms drive the spring pin, the sense and/or magnitude of the principal component of contact arm force applied by the V-notches may vary to a minor degree due to the geometry of the various pivot axes that are involved, but the inclusion of the V-notches and their geometry provides an important contribution toward maximizing the effectiveness of the blow-apart force of the contact arms in completing the trip. A further benefit is that subsequent excessive contact arm rebound is avoided because the geometry of the rebound promotes more efficient absorption of rebound energy by operating spring 130. This aspect of circuit breaker 40** is the subject of co-pending, commonly assigned patent application CIRCUIT BREAKER WITH IMPROVED TRIP MECHANISM Ser. No. 08/772,042 filed Dec. 19, 1996.

FIGS. 6–10 show operating mechanism assembly 68 in the tripped state after latch 80 has been unlatched. Operation of circuit breaker 40 from on to tripped state occurs because latch 80 has been unlatched by operation of the aforementioned trip mechanism. It is therefore appropriate to now describe the trip mechanism.

FIGS. 2 and 14–24 show the trip mechanism 140 and certain of its components. Trip mechanism 140 comprises a magnetic trip actuator 142 and a thermal trip actuator 144. Magnetic trip actuator 142 comprises a ferromagnetic part 146 affixed to a portion of base 42. Ferromagnetic part 146 comprises spaced apart parallel sides. Respective sides 147 of a trip member 148 are mounted on respective sides of ferromagnetic part 146 providing for pivotal movement of the trip member about an axis 150. The trip member further comprises a bridge 152 that extends between its sides 147 and that includes a lever 154 projecting from the bridge. One end portion of a ferromagnetic member 156 is disposed against, and joined to, the underside of bridge 152. The opposite end of member 156 projects from the bridge in the opposite direction from lever 154.

Figure 14:
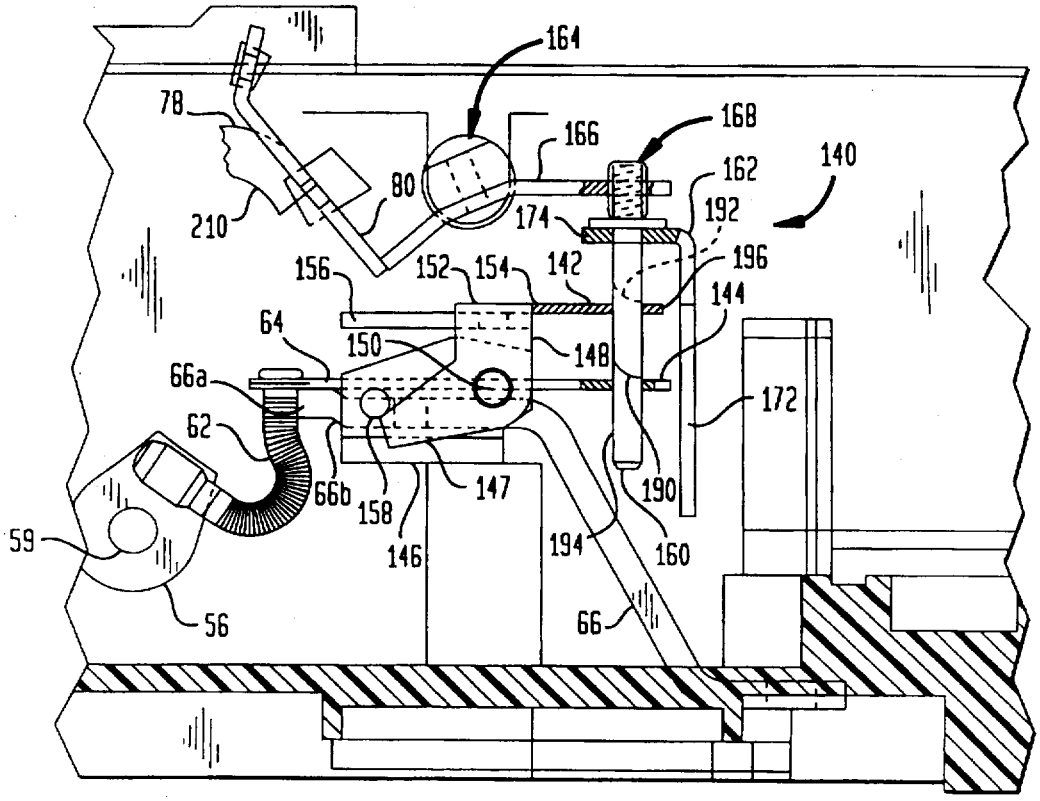
FIG. 14 is a view in the same direction as the views of FIGS. 11–13, omitting certain portions of the operating mechanism assembly for illustrative convenience, but including a trip mechanism.
Figure 15:
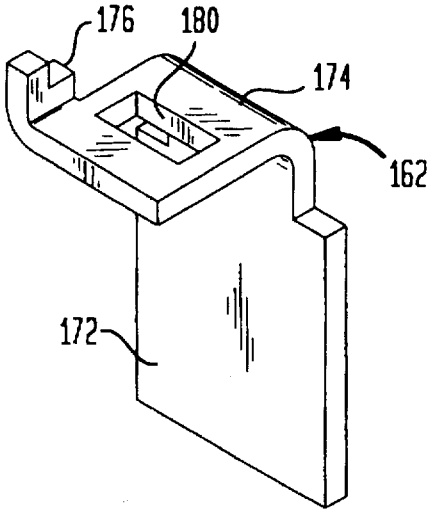
FIGS. 15–18 are respective perspective, top plan, rear side elevation, and right side elevation views of a component of the trip mechanism by itself apart from the trip mechanism.
Figure 16:
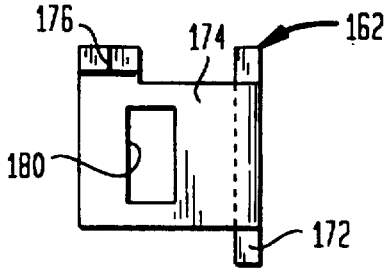
Figure 17:
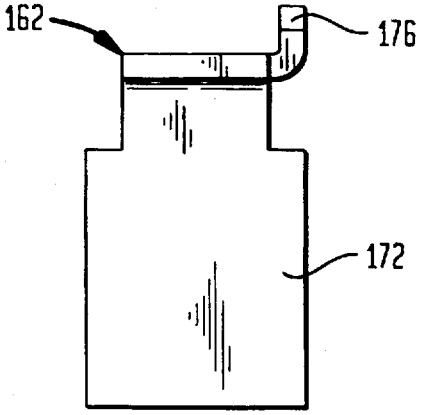
Figure 18:
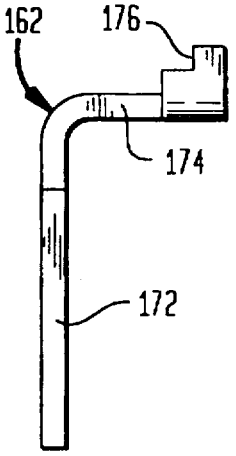

FIG. 14 shows trip mechanism 140 in its non-tripped state. Member 156 is spaced parallel with a portion of load terminal 66. A spring 149 (see FIG. 2) biases trip member 148 to a maximum clockwise position wherein the trip member's sides 147 abut stops 158 on ferromagnetic part 146.

Figure 22:
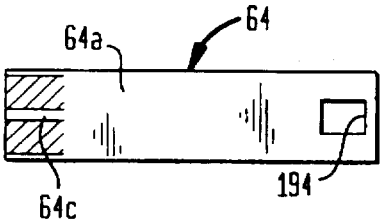
FIGS. 22–24 are respective top plan, left side elevation, and bottom plan views of still another component of the trip mechanism apart from the trip mechanism.
Figure 23:
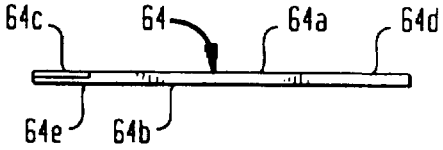
Figure 24:
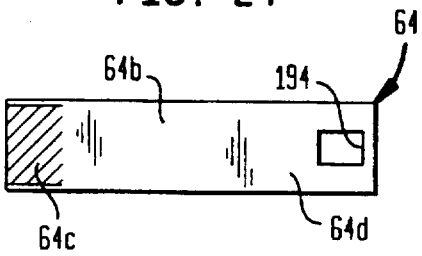

Bi-metal strip 64, details of which are shown in FIGS. 22–24, forms the thermal trip actuator 144. The bi-metal 64 is known to those skilled in the art. In the present embodiment, the bi-metal 64 actually comprises three metal layers and may be considered a tri-metal or a multi-metal, but may still be referred to as a bi-metal. The active or high expansion side of the bi-metal 64, which is connected to the load terminal 66 is a metal layer comprising nickel, chromium and iron. The inactive or low expansion side of the bi-metal 64, which is connected to the braid 62, is a metal layer comprising INVAR, which is a composition metal having a relatively high content of nickel and iron. The middle layer of the bi-metal 64 comprises copper, as well as two percent (2%) silver. The bi-metal 64 used in the present embodiment is known as Hood HR50, and is available from Hood & Co., Inc. of Hamburg, Pa. As is also known, the thickness of the bi-metal 64 used generally depends on the Ampere rating of the circuit breaker. For example, in a 225 Ampere rated circuit breaker, the Hood HR50 bi-metal used is 0.045 inches thick, and CDA 110, which is 0.125 inch thick copper, is used for the load terminal 66. In a 200 Ampere rated circuit breaker, the load terminal 66 uses CDA 260, which is 0.125 inch thick brass. A reason that this is done is to increase the heating effect at lower currents, and is also known. It is also believed that 150 and 175 Ampere rated circuit breakers may use 0.032 or 0.035 inch thick Hood HR50, with the load terminal 66 using CDA 260. It should be understood that comparable bi-metals (whether tri-metals or multi-metals) are, of course, available from other sources and are known, as are the types of corresponding materials that are used for load terminals that are to be used with such bi-metals in various Ampere rated circuit breakers.

FIG. 14 shows bi-metal strip 64 in its non-trip state. The strip is flat and parallel with member 156, passing from its mounting on one end of load terminal 66 through the open space between the sides of ferromagnetic part 146 and trip member 148.

Trip mechanism 140 further comprises a trip plunger 160, a trip plunger guide 162, a trip bar 164, a trip lever 166, a calibration screw 168, and a torsion spring 170. Detail of trip plunger guide 162 appears in FIGS. 15–18, while that of trip plunger 160 appears in FIGS. 19–21. Trip plunger guide 162 comprises an upright side 172 via which it is uprightly supported, as shown in FIG. 14. An apertured flange 174 is formed at the upper end of side 172. At one of its free corners, flange 174 is formed with a catch 176 onto which one end of spring 149 is hooked. FIG. 2 shows the opposite end of spring 149 hooked onto a tab of trip member 148, the tab not appearing in FIG. 14 for clarity of illustration. Flange 174 contains a rectangular-shaped aperture 180 that provides both proper orientation and travel guidance for trip plunger 160.

Figure 19:
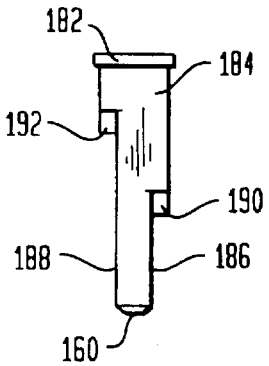
FIGS. 19–21 are respective front elevation, left side elevation, and bottom plan views of another component of the trip mechanism by itself apart from the trip mechanism.
Figure 20:
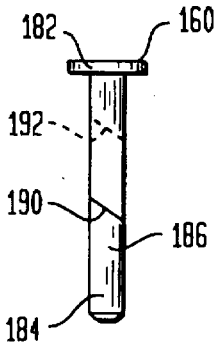
Figure 21:
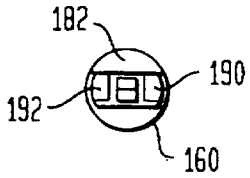

FIGS. 19–21 show trip plunger 160 to comprise a head 182 and a shank 184. The portion of shank 184 immediately proximate head 182 has a nominal rectangular-shaped cross section for passing relatively closely through aperture 180. On the short sides of its nominally rectangular cross section, shank 182 comprises respective notches 186, 188 that extend proximally from the distal end of the shank along a portion of the shank's length. Notch 186 extends from the shank's distal end, a lesser distance than does notch 188. The fit of shank 182 to aperture 180 circumferentially orients plunger 160 so that it cannot twist to any appreciable extent in the aperture. The proximal ends of notches 186, 188 terminate at respective surfaces 190, 192 respectively. As shown by FIG. 14, these surfaces 190, 192 are disposed for respective coaction with lever 154 and bi-metal 64 respectively.

FIGS. 22 and 24 show the free end of bi-metal 64 to comprise an aperture 194. FIG. 14 shows the portion of shank 184 below surface 190 extending through aperture 194. It also shows the free end of lever 154 to comprise a projection 196 disposed to one side of shank 184 and lying between surfaces 190 and 192. A portion of the margin of bi-metal aperture 194 confronts a portion of surface 190. A portion of projection 196 confronts a portion of surface 192, namely 192*a*. When trip mechanism 140 is operated by actuator 142, the portion of projection 196 confronting surface 192 acts against that surface to push trip plunger 160 upward from the position shown in FIG. 14. Similarly, when the trip mechanism is operated by actuator 144, the portion of the margin of aperture 194 confronting a portion of surface 190, namely surface 190*a*, acts against that surface to push trip plunger 160 upward from the position shown in FIG. 14. Detailed explanation of the operation of actuators 142, 144 will be given later.

Coils of torsion spring 170 (see FIG. 2) are disposed around the outside of trip bar 164 proximate latch 80. One arm 170*a* of spring 170 extends to engage latch 80. The other arm 170*b* of spring 170 extends to engage the upper surface of the portion of trip lever 166 that projects to overlie trip plunger 160. Torsion spring 170 therefore acts between latch 80 and trip bar 164 to urge the trip bar clockwise about axis 104 and latch 80 clockwise about a pivot joint 195 on frame sides 70, 72.

Calibration screw 168 is threaded in a hole in trip lever 166 so as to align with trip plunger head 182. Because the trip bar and lever are being biased clockwise about axis 104, the lower end of screw 168 is biased into abutment with the top of head 182, as shown in FIG. 14. This forces head 182 against the top surface of flange 174, defining a downward limit of travel for the trip plunger. In the state shown in FIG. 14, trip lever 166 is in interference with latch 80, holding the latch latched. Detail of how the latch and cradle interact will be presented later.

Tripping of trip mechanism 140 can be initiated by either actuator 142, 144. Upon either one of the two trip actuators initiating a trip, plunger 160 is pushed upward in FIG. 14, causing trip bar 164 and lever 166 to pivot counterclockwise. Although the upward trip plunger motion is resisted by spring 170 (and also by spring 149 when actuator 142 initiates a trip), the spring force that opposes the plunger travel is relatively light so that upward motion of plunger 160 is not appreciably resisted. A certain amount of upward plunger travel pivots trip lever 166 out of interference with latch 80. At that point the latch is released, thereby enabling it to pivot counterclockwise about pivot joint 195 out of interference with cradle 78, unlatching operating mechanism assembly 68 so that cradle 78 becomes free to pivot clockwise about axis 96. It is believed that to obtain maximum effectiveness of the force of the swinging contact arms, operating mechanism assembly 68 should be unlatched before its spring 130 goes over center.

It can be appreciated that the extent to which calibration screw 168 is threaded into lever 166 determines how much travel of plunger 160 is needed to move latch 80 out of interference with cradle 78. The calibration screw serves to set a desired trip point by compensating for tolerance variation in a mass-produced bi-metal strip 64.

The force of operating spring 130 is continuously applied to the toggle mechanism via spring pin 128. This force is transmitted through the upper toggle to also act on pivots 101, which transmit the force to cradle 78. The unlatching of the operating mechanism assembly by the trip mechanism and latch results in cradle 78 becoming able to pivot clockwise. The pulling force that is being exerted by operating spring 130 on spring pin 128 now moves both upper toggle 74 and the unlatched cradle 78. Once the spring-loaded toggle mechanism has collapsed sufficiently to go over-center, spring 130 becomes active to further the collapse of the toggle. This is because the spring force being applied to cradle 78 radially of the cradle's pivot axis 96 on supports 95 is now applied to the swinging contact arms 56 so as to drive them further clockwise until they abut stops 129.

Detail of how cradle 78 and latch 80 interact will now be explained with reference to FIGS. 2, and 6–14. Latch 80 has two tabs 200 on opposite sides that fit into small holes 202 in frame sides 70, 72 to form pivot joint 195. Below and to the right of pivot joint 195 (as viewed with reference to FIG. 2), latch 80 contains a slot 204 shown best in FIG. 8. This slot is proximate frame side 70. Arm 170*a* (not shown in FIGS. 6–10) of spring 170 fits into slot 204 for urging the latch clockwise about pivot joint 195. The latch also has other tabs 206, in approximate alignment with the bottom of slot 204, that fit into holes 208 in the frame sides. While edges of holes 208 would limit the extent to which latch 80 can pivot about pivot joint 195, they are not believed to interfere with the functional relationship between the latch and cradle. The side of cradle 78 proximate frame side 72 has an arm 210 which has a curved edge surface 212. The clockwise end of arm 210 has an edge surface 214 that forms a corner 217 with edge surface 212. Latch 80 has a notch 216 immediately above and to the left of the tab 206 (as viewed with reference to FIG. 2) that fits into the hole 208 in frame side 72. This notch 216 has an edge surface 218 that is perpendicular to frame side 72.

When latch 80 is in the latched state latching operating mechanism assembly 68 and cradle 78, as shown in FIGS. 11–14 with trip lever 166 in interference with the latch as particularly shown in FIG. 14, corner 217 is disposed in notch 216 with edge surfaces 214 and 218 in mutual abutment. Because latch 80 is thereby prevented by the trip lever from pivoting counterclockwise about pivot joint 195, the forced mutual abutment of edge surfaces 214 and 218 is maintained, and hence latch 80 prevents cradle 78 from moving further clockwise, thereby maintaining operating mechanism assembly 68 latched.

However, once latch 80 is unlatched by trip mechanism 140, cradle 78 is no longer constrained by trip lever 166 and is therefore able to pivot clockwise. The mutually abutting edge surfaces 214 and 218 are in a geometric relationship between themselves and with the spring force acting to rotate the cradle clockwise, which, once the trip lever has released the latch, converts the force being applied from operating spring 130 into a camming action. This camming action is caused by cradle arm 210 camming latch 80 counterclockwise out of the way to allow the spring force to drive the cradle clockwise, and to further collapse the toggle mechanism, as explained above. This drives the swinging contact arms 56 further open until they abut stops 129. The handle arm and handle move to trip position in the process.

Once the fault that caused a trip has been corrected, and the trip actuators 142, 144 of trip mechanism 140 are in conditions that allow circuit breaker 40 to be reset, operation of handle 46 from the tripped position to the off position will reset the circuit breaker. When the handle is moved to off, handle arm 76 pivots counterclockwise. Its bridge 83 is forced against a lower edge surface 222 of the side of cradle 78 that contains arm 210, forcing the cradle to pivot counterclockwise about axis 96. As the cradle pivots counterclockwise, edge surface 212 rides along latch 80 beginning to reset the latch to latched condition.

Once the circuit breaker handle reaches off position, latch 80 has been moved by spring 170 to a position that catches corner 217 and positions edge surfaces 214 and 218 in confrontation for mutual abutment. Trip lever 166 has also returned to interference with the latch. With the cradle now latched, it cannot pivot clockwise until latch 80 is again unlatched.

Operation of handle 46 from off position toward on position causes handle arm 76 to pivot clockwise, with bridge 83 moving away from cradle edge surface 222. Handle arm tab 84 now pulls on the end of spring 130 hooked to it, and the spring in turn pulls on spring pin 128. This action begins expanding the toggle mechanism, forcing the spring pin against lower toggle 122 to pivot cross bar 58 counterclockwise, and thereby also pivot contact arms 56. Because blow-open pins 118 have already moved back over the knees 116 of slots 114, as described earlier, springs 120 oppose the forces acting to move contact arms 56 closed against contacts 52. As the spring-loaded toggle mechanism goes over-center, operating spring 130 becomes effective to force the contact arms to final position (i.e. on position) where their contacts 54 are forced against contacts 52.

Detailed explanations of the operation of magnetic trip actuator 142 and of thermal trip actuator 144 to effectuate tripping of circuit breaker 40 can now be meaningfully understood.

As manufactured, bi-metal 64 is nominally flat and straight. In a non-trip state of thermal actuator 144, bi-metal 64 remains flat and straight; however when heated to a certain point, its shape begins to warp, pushing trip plunger 160 upwardly. Increasing thermal energy in the bi-metal increasingly warps the bi-metal. This warping is caused by the bi-metal's construction, consisting of conjoined lamina **64*a*, 64*b*, which are respective materials characterized by different coefficients of thermal expansion, that of 64*a* being less than that of 64*b*. The load terminal 66** has a nominally rectangular transverse cross section.

Bi-metal strip 64 has a first end portion **64*c* disposed flat against, and joined to, an end portion 66*a* of load terminal 66 and a second end portion 64*d* disposed in spaced relation to load terminal 66. This spacing of end portion 64*d* in parallel overlying relation to an underlying portion of the load terminal occurs because of an offset bend 66*b* formed in load terminal 66 for joining end portion 66*a* with the remainder of the load terminal. In this way, bi-metal 64 is cantilever-mounted on load terminal 66 via the joining of end portions 64*c* and 66*a*. End portion 64*c* may be considered an inactive portion of the bi-metal while end portion 64*d* may be considered an active portion. It is believed that when electric current flows in load terminal 66, the current passes between braid 62 and load terminal portion 66*a* substantially only through the inactive portion 64*c* of the bi-metal so that substantially no current passes through the bi-metal's active portion 64*d***. It is therefore believed that the bi-metal should be subjected to less stress than might otherwise be the case.

Current flow through the inactive bi-metal portion **64*c* creates some localized ohmic heating which consequently flows by thermal conduction to the active bi-metal portion 64*d*. The entire bi-metal is also exposed to the temperature of its surroundings. So long as the ohmic heat input to the bi-metal can be dissipated to the surroundings to maintain the thermal energy in the bi-metal below a certain trip energy level, the active portion of the bi-metal will not warp sufficiently to enable a trip. By facing the lower coefficient of thermal expansion material of the bi-metal away from load terminal end portion 66*a*, warping of the strip will occur in the direction away from the load terminal. Whenever the thermal energy in the bi-metal exceeds the trip energy level, the bi-metal's active portion will have warped sufficiently from its quiescent unwarped shape shown in the Figures to have pushed plunger 160 sufficiently upward to have pivoted trip bar 164 and lever 166 and released cradle 78, enabling a trip. The trip is completed by the spring-loaded toggle mechanism trip operation described earlier. It should be noticed from FIGS. 19 and 20 that only the far right portion 190*a* of surface 190, as viewed in FIG. 14, is perpendicular to the length of plunger shank 182. The remainder 190*b* of surface 190 inclines upwardly away from the left-hand end of that far right portion so that it is only the far right portion 190*a* that is contacted by bi-metal strip 64. This construction for surface 190** is believed to provide better interaction between the plunger and the bi-metal strip as the bi-metal strip warps.

It is believed that the thermal energy in the active portion of the bi-metal depends not only on the energy conducted from the inactive portion, but also on its ambient surroundings. By arranging the active portion of the bi-metal to relatively closely face an underlying portion of load terminal 66, thermal energy that results from current flow through that underlying portion of the load terminal may transfer convectively and/or radiantly to the bi-metal, augmenting the thermal energy in it. This is believed useful in accelerating tripping, particularly when a fault is caused by a short circuit, and it is further believed that the potential for damaging the bi-metal upon occurrence of a fault, especially a short circuit type fault, is reduced.

In the quiescent non-trip state of magnetic actuator 142, ferromagnetic member 156 is disposed substantially parallel with the portion of load terminal 66 disposed beneath it. When the magnitude of current flow in load terminal 66 exceeds a limit at which actuator 142 should enable a trip, the corresponding electromagnetic force applied to member 156 due to the current flow in the load terminal, will have pivoted trip member 148 counterclockwise about axis 150 against the opposing force of spring 149 to an extent sufficient to cause a trip. As the trip member pivots counterclockwise from the position shown in FIG. 14, the portion of the margin of projection 196 confronting plunger surface 192 acts against that surface to push trip plunger 160 upward. When plunger 160 has been pushed sufficiently upward to have pivoted trip bar 164 and lever 166 to release cradle 78, the trip is completed by the spring-loaded toggle mechanism trip operation described earlier. It should be noticed that surface 192 has a construction 192*a*, 192*b* like that of surface 190 which is believed to provide better interaction between the plunger and the trip member as the trip member pivots. The far right hand portion 192*a* is perpendicular to the length of the plunger shank portion. Portion 192*b* inclines upwardly away from the left-hand end of that far right portion so that it is only the far right portion 192*a* that is contacted by projection 196 of lever 154.

In light of the foregoing description, it should be recognized that only one of the two trip actuators 142 or 144 is apt to actually be pushing on plunger 160 at any given time. In other words, it is believed that it is less likely that upward forces will be simultaneously applied to both surfaces 190*a*, 192*a* by both actuators 142, 144. Thus two separate actuators, each of which is capable of independently operating the plunger, may at times be simultaneously pushing on the plunger while at other times only one of them may be pushing. Their conjunctive incorporation into a circuit breaker, however, is toward the objective of completing a blow-open-initiated trip in a minimum or at least lesser amount of time from occurrence of a fault that should cause the circuit breaker to trip. Because a fault may be due to current, temperature, or a combination of both, the disclosed trip mechanism and the two trip actuators is believed to address all such faults that should cause a circuit breaker to trip. It is believed that the trip mechanism and actuators are efficiently organized to coact with operating mechanism 68 and represent an important advance in circuit breaker technology.

While trip mechanism 140 has been shown as an integral part of circuit breaker 40, the trip mechanism per se could be packaged as a trip unit that is functionally associated with a circuit protection device that contains an interruptable circuit path that is interrupted by the trip unit upon occurrence of a fault.

While the present invention has been described with reference to a preferred embodiment as currently contemplated, it should be understood that the invention is not intended to be limited to that embodiment. Accordingly, the invention is intended to encompass various modifications and arrangements that are within the scope of the claims.

What is claimed is:

1. An actuator for enabling a trip comprising:

a conductor through which current passes;

a thermally responsive bi-metal having a first end portion which is disposed against a portion of the conductor and through which at least a portion of current carried by the conductor passes;

the bi-metal further comprising a second end portion that is disposed in spaced relation to the conductor and is cantilever-mounted on the portion of the conductor via the bi-metal's first end portion, and that increasingly warps as thermal energy in the bi-metal increases for enabling a trip upon attaining a certain degree of warping.

2. An actuator as set forth in claim 1 wherein the bi-metal is nominally flat and straight.

3. An actuator as set forth in claim 2 wherein the portion of the conductor against which the first end portion of the bi-metal is disposed has a flat surface, and he bi-metal's first end portion is disposed flat against he flat surface of the portion of the conductor.

4. An actuator as set forth in claim 3 wherein the conductor comprises a further portion extending from its first-mentioned portion offset from, but in parallel relation to, its first-mentioned portion, and the bi-metal, when nominally flat and straight, extends parallel to, but spaced from, the further portion of the conductor.

5. An actuator as set forth in claim 4 wherein the conductor is a member having a nominally rectangular transverse cross section, and the member contains a bend that joins the first-mentioned and the further portions of the conductor.

6. An actuator as set forth in claim 1 wherein the second portion of the bi-metal comprises an aperture providing for operative coupling of warping of the bi-metal to a trip mechanism.

7. An actuator as set forth in claim 1 further including a conductive braid, and wherein the first end portion of the bi-metal, the portion of the conductor, and a portion of the braid are joined together with the bi-metal being sandwiched between the portions of the conductor and the braid.

8. An actuator as set forth in claim 7 wherein the bi-metal, as manufactured, is nominally flat and straight, the portion of the conductor against which the first end portion of the bi-metal is disposed has a flat surface, the bi-metal's first end portion is disposed flat against the flat surface of the portion of the conductor.

9. An actuator as set forth in claim 8 wherein the conductor comprises a further portion extending from its first-mentioned portion offset from, but in parallel relation to, its first-mentioned portion, and the bi-metal, when nominally flat and straight, extends parallel to, but spaced from, the further portion of the conductor.

10. A circuit breaker comprising:

a first conductor member through which current passes from a line terminal to a load terminal;

a mounting movably mounting the first conductor member for selective operation to a circuit-making condition enabling current to flow between the line and load terminals and to a circuit-breaking condition preventing current flow between the line and load terminals;

an operating mechanism for moving the first conductor member;

a trip mechanism that operates via the operating mechanism to enable the first conductor member to move from circuit-making condition to circuit-breaking condition and thereby trip the circuit breaker; and an actuator for causing the trip mechanism to enable a trip comprising:

a second conductor member through which current carried by the first conductor member passes;

a thermally responsive bi-metal having a first end portion which is disposed against a portion of the second conductor member and through which at least a portion of current carried by the two conductor members passes;

the bi-metal further comprising a second end portion that is disposed in spaced relation to the second conductor member and is cantilever-mounted on the portion of the second conductor member via the bi-metal's first end portion, that increasingly warps as thermal energy in the bi-metal increases, and that, upon attaining a certain degree of warping, causes the trip mechanism to enable a trip by enabling the first conductor member to move from circuit-making condition to circuit-breaking condition.

11. A circuit breaker as set forth in claim 10 wherein the bi-metal, as manufactured, is nominally flat and straight.

12. A circuit breaker as set forth in claim 11 wherein the portion of the second conductor member against which the first end portion of the bi-metal is disposed has a flat surface, and the bi-metal's first end portion is disposed flat against the flat surface of the portion of the second conductor member.

13. A circuit breaker as set forth in claim 12 wherein the second conductor member comprises a further portion extending from its first-mentioned portion offset from, but in parallel relation to, its first-mentioned portion, and the bi-metal, when nominally flat and straight, extends parallel to, but spaced from, the further portion of the second conductor member.

14. A circuit breaker as set forth in claim 13 wherein the second conductor member has a nominally rectangular transverse cross section and contains a bend that joins the first-mentioned and the further portions of the second conductor member.

15. A circuit breaker as set forth in claim 10 wherein the second portion of the bi-metal comprises an aperture providing for operative coupling of warping of the bi-metal to the trip mechanism.

16. A circuit breaker as set forth in claim 10 further including a conductive braid through which current is carried between the first and second conductor members, and wherein the first end portion of the bi-metal, the portion of the second conductor member, and a portion of the braid are joined together with the bi-metal being sandwiched between the portions of the second conductor member and the braid.

17. A circuit breaker as set forth in claim 16 wherein the bi-metal is nominally flat and straight, the portion of the second conductor member against which the first end portion of the bi-metal is disposed has a flat surface, the bi-metal's first end portion is disposed flat against the flat surface of the portion of the second conductor member.

18. A circuit breaker as set forth in claim 17 wherein the second conductor member comprises a further portion extending from its first-mentioned portion offset from, but in parallel relation to, its first-mentioned portion, and the bi-metal, when nominally flat and straight, extends parallel to, but spaced from, the further portion of the second conductor member.

19. A circuit breaker as set forth in claim 16 wherein the conductive braid is joined to both the first and second conductor members, and wherein the first conductor member is pivotally mounted for swinging motion between circuit-making and circuit-breaking conditions.

20. A circuit breaker as set forth in claim 10 further including a conductive braid joined to both the first and second conductor members for carrying current between the first and second conductor members.

21. A circuit breaker as set forth in claim 10 in which the current passing between the first and second conductor members passes substantially only through the first end portion of the bi-metal so that substantially no current passes through the bi-metal's second end portion.

* * * * *